US010393392B2

(12) United States Patent
Choi et al.

(10) Patent No.: US 10,393,392 B2
(45) Date of Patent: Aug. 27, 2019

(54) AIR CONDITIONER

(71) Applicant: LG ELECTRONICS INC., Seoul (KR)

(72) Inventors: Jaeheuk Choi, Seoul (KR); Sangil Park, Seoul (KR); Seyoon Oh, Seoul (KR); Yoonho Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 561 days.

(21) Appl. No.: 15/018,584

(22) Filed: Feb. 8, 2016

(65) Prior Publication Data

US 2016/0231009 A1 Aug. 11, 2016

(30) Foreign Application Priority Data

Feb. 9, 2015 (KR) ..... 10-2015-0019736

(51) Int. Cl.
*F24F 3/14* (2006.01)
*F24F 1/022* (2019.01)

(52) U.S. Cl.
CPC ..... *F24F 3/1405* (2013.01); *F24F 1/022* (2013.01); *F24F 3/1429* (2013.01); *F24F 2003/1446* (2013.01); *F24F 2203/021* (2013.01)

(58) Field of Classification Search
CPC ..... F24F 12/003; F24F 12/006; F24F 3/147; F24F 7/08; F24F 1/02; F24F 1/022; F24F 2221/54; F24F 2012/007; F24F 3/1405; F24F 3/1429; F24F 2003/1446; F24F 2203/021
See application file for complete search history.

(56) References Cited

U.S. PATENT DOCUMENTS 5,049,199 A * 9/1991 Capen ..... B01D 1/04 127/9
6,216,484 B1 * 4/2001 Yun ..... F24F 1/022 62/325

(Continued)

FOREIGN PATENT DOCUMENTS

DE 4243429 A1 6/1994
EP 1 621 822 A1 2/2006

(Continued)

OTHER PUBLICATIONS

"Machine Translation of KR 20040044099 A, Yun, May 2004".*

*Primary Examiner* — Frantz F Jules
*Assistant Examiner* — Martha Tadesse
(74) *Attorney, Agent, or Firm* — Dentons US LLP

(57) ABSTRACT

An air conditioner is disclosed. The air conditioner includes a case having a first and a second indoor suction port and a first and a second indoor discharge port, an air conditioning unit having a first and a second heat exchanger, a first indoor flow channel connected between the first indoor suction port and the first indoor discharge port, a second indoor flow channel connected between the second indoor suction port and the second indoor discharge port, and a condensing unit to receive regenerated air, heat-exchanged with the condenser, from one of the first indoor flow channel and the second indoor flow channel, and perform a heat exchange between the regenerated air and a cooling fluid having a lower temperature than the regenerated air.

14 Claims, 6 Drawing Sheets

(56) References Cited

U.S. PATENT DOCUMENTS

| | | | | |
|---|---|---|---|---|
| 6,557,365 | B2 * | 5/2003 | Dinnage | F24F 3/1405 62/271 |
| 7,047,751 | B2 * | 5/2006 | Dinnage | F24F 3/1405 62/94 |
| 2006/0196195 | A1 * | 9/2006 | Ikegami | B01D 53/261 62/94 |
| 2010/0257885 | A1 * | 10/2010 | Matsui | F24F 3/1411 62/271 |
| 2010/0300123 | A1 * | 12/2010 | Park | B01D 53/06 62/94 |
| 2011/0308265 | A1 * | 12/2011 | Phannavong | F24F 12/001 62/160 |
| 2014/0318369 | A1 * | 10/2014 | Lee | F24F 3/1423 95/91 |

FOREIGN PATENT DOCUMENTS

| | | | | |
|---|---|---|---|---|
| EP | 2 264 375 | A2 | 12/2010 | |
| JP | 2000314540 | A * | 11/2000 | F24F 3/1423 |
| JP | 2003-035436 | A | 2/2003 | |
| JP | 2010-249485 | A | 11/2010 | |
| KR | 20040044099 | A * | 5/2004 | F24F 1/022 |
| KR | 20040044099 | A * | 5/2004 | F24F 1/022 |
| KR | 10-2009-0121620 | A | 11/2009 | |
| KR | 10-0947617 | B1 | 3/2010 | |
| KR | 10-2010-0135526 | A | 12/2010 | |
| KR | 10-1191274 | B1 | 10/2012 | |
| KR | 10-2014-0022785 | A | 2/2014 | |
| KR | 10-1363864 | B1 | 2/2014 | |

* cited by examiner

AIR CONDITIONER

CROSS-REFERENCE TO RELATED APPLICATION

This application claims the priority benefit of Korean Patent Application No. 10-2015-0019736, filed on Feb. 9, 2015 in the Korean Intellectual Property Office, the disclosure of which is incorporated herein by reference.

BACKGROUND OF THE INVENTION

1. Field of the Invention

The present invention relates to an air conditioner.

2. Description of the Related Art

In general, an air conditioner is an apparatus that cools or heats a room or conditions air using a refrigeration cycle of a refrigerant including a compressor, a condenser, an expansion device, and an evaporator in order to provide a more comfortable indoor environment to a user.

An example of the air conditioner is an air handling unit, which is coupled to an air conditioning system in a building to mix outdoor air with indoor air and to supply the mixed air into a room.

In a conventional air conditioner, however, when outdoor air is supplied into a room, the outdoor air is dehumidified through a refrigeration cycle using a refrigerant, with the result that power consumption is increased.

An example of such a conventional air conditioner is disclosed in Korean Patent Application Publication No. 10-2010-0128812.

SUMMARY OF THE INVENTION

Therefore, the present invention has been made in view of the above problems, and it is an object of the present invention to provide an air conditioner that is capable of dehumidifying outdoor air with low power consumption.

It is another object of the present invention to provide an air conditioner that is capable of discharging both air having passed through an evaporator and air having passed through a condenser indoors in a state in which the temperature of the air discharged indoors is low.

It is another object of the present invention to provide an air conditioner that is capable of discharging both air having passed through an evaporator and air having passed through a condenser indoors in a state in which the humidity of the air discharged indoors is low.

It is a further object of the present invention to provide an air conditioner that is capable of reducing a ratio in high and low pressure of a first heat exchanger to a second heat exchanger, thereby reducing an amount of condensed radiation.

In accordance with the present invention, the above and other objects can be accomplished by the provision of an air conditioner including a case provided with a first indoor suction port, a second indoor suction port, a first indoor discharge port, and a second indoor discharge port, an air conditioning unit disposed in the case, the air conditioning unit including a first heat exchanger operating as one selected from between an evaporator and a condenser and a second heat exchanger operating as the other selected from between the evaporator and the condenser, the air conditioning unit being operated according to a heat pump cycle, a first indoor flow channel connected between the first indoor suction port and the first indoor discharge port, the first indoor flow channel being configured such that indoor air suctioned through the first indoor suction port passes through the first heat exchanger and is then discharged through the first indoor discharge port, a second indoor flow channel connected between the second indoor suction port and the second indoor discharge port, the second indoor flow channel being configured such that indoor air suctioned through the second indoor suction port passes through the second heat exchanger and is then discharged through the second indoor discharge port, and a condensing unit for receiving regenerated air, heat-exchanged with the condenser, from one selected from between the first indoor flow channel and the second indoor flow channel and performing heat exchange between the regenerated air and a cooling fluid having a lower temperature than the regenerated air so as to condense moisture contained in the regenerated air.

The cooling fluid may be outdoor air.

The case may be further provided with a cooling fluid suction port, through which the outdoor air is suctioned, and a cooling fluid discharge port, through which the outdoor air is discharged.

The cooling fluid may be dehumidified air having passed through the evaporator from one selected from between the first indoor flow channel and the second indoor flow channel.

A bypass channel for guiding the dehumidified air to the condensing unit may be disposed in at least one selected from between the first indoor flow channel and the second indoor flow channel, and the dehumidified air having passed through the bypass channel may be discharged through a cooling fluid discharge port formed in the case.

The cooling fluid discharge port may be connected to one selected from between the indoors and the outdoors.

The first indoor flow channel may include a first main indoor flow channel connected from the first heat exchanger to the first indoor discharge port and a first regeneration indoor flow channel connected from the first heat exchanger to the first indoor discharge port via the condensing unit.

Inlet and outlet sides of the first regeneration indoor flow channel may be connected to the first main indoor flow channel.

The second indoor flow channel may include a second main indoor flow channel connected from the second heat exchanger to the second indoor discharge port and a second regeneration indoor flow channel connected from the second heat exchanger to the second indoor discharge port via the condensing unit.

Inlet and outlet sides of the second regeneration indoor flow channel may be connected to the second main indoor flow channel.

The first indoor flow channel may include a first main indoor flow channel connected from the first heat exchanger to the first indoor discharge port and a first regeneration indoor flow channel connected from the first heat exchanger to the first indoor discharge port via the condensing unit, the second indoor flow channel may include a second main indoor flow channel connected from the second heat exchanger to the second indoor discharge port and a second regeneration indoor flow channel connected from the second heat exchanger to the second indoor discharge port via the condensing unit, and the condensing unit may be connected to one selected from between the first regeneration indoor flow channel and the second regeneration indoor flow channel for receiving the regenerated air and performing heat exchange between the regenerated air and the cooling fluid to condense moisture contained in the regenerated air.

The cooling fluid may be outdoor air, and the case may be further provided with a cooling fluid suction port, through which the outdoor air is suctioned, and a cooling fluid discharge port, through which the outdoor air is discharged.

The cooling fluid may be dehumidified air, the dehumidified air being formed as the result of having passed through the evaporator from one selected from between the first indoor flow channel and the second indoor flow channel.

A bypass channel for guiding the dehumidified air to the condensing unit may be disposed in at least one selected from between the first indoor flow channel and the second indoor flow channel, and the dehumidified air having passed through the bypass channel may be discharged through a cooling fluid discharge port formed in the case.

The cooling fluid discharge port may be connected to one selected from between the indoors and the outdoors.

The condensing unit may include a condensing body, a regenerated air flow channel, formed in the condensing body, along which the regenerated air flows, a cooling fluid flow channel, formed in the condensing body, along which the cooling fluid flows, and a drainage part disposed at the lower side of the condensing body for storing condensed water.

The regenerated air flow channel may be formed so as to surround the cooling fluid flow channel.

The condensing unit may be disposed in an inclined state such that the condensed water gathers in the drainage part.

The air conditioner may further include a first main damper disposed in the first main indoor flow channel for opening and closing the first main indoor flow channel, a first inlet damper disposed in an inlet side of the first regeneration indoor flow channel for opening and closing the first regeneration indoor flow channel, and a first outlet damper disposed in an outlet side of the first regeneration indoor flow channel for opening and closing the first regeneration indoor flow channel.

The air conditioner may further include a second main damper disposed in the second main indoor flow channel for opening and closing the second main indoor flow channel, a second inlet damper disposed in an inlet side of the second regeneration indoor flow channel for opening and closing the second regeneration indoor flow channel, and a second outlet damper disposed in an outlet side of the second regeneration indoor flow channel for opening and closing the second regeneration indoor flow channel.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Figure 1:
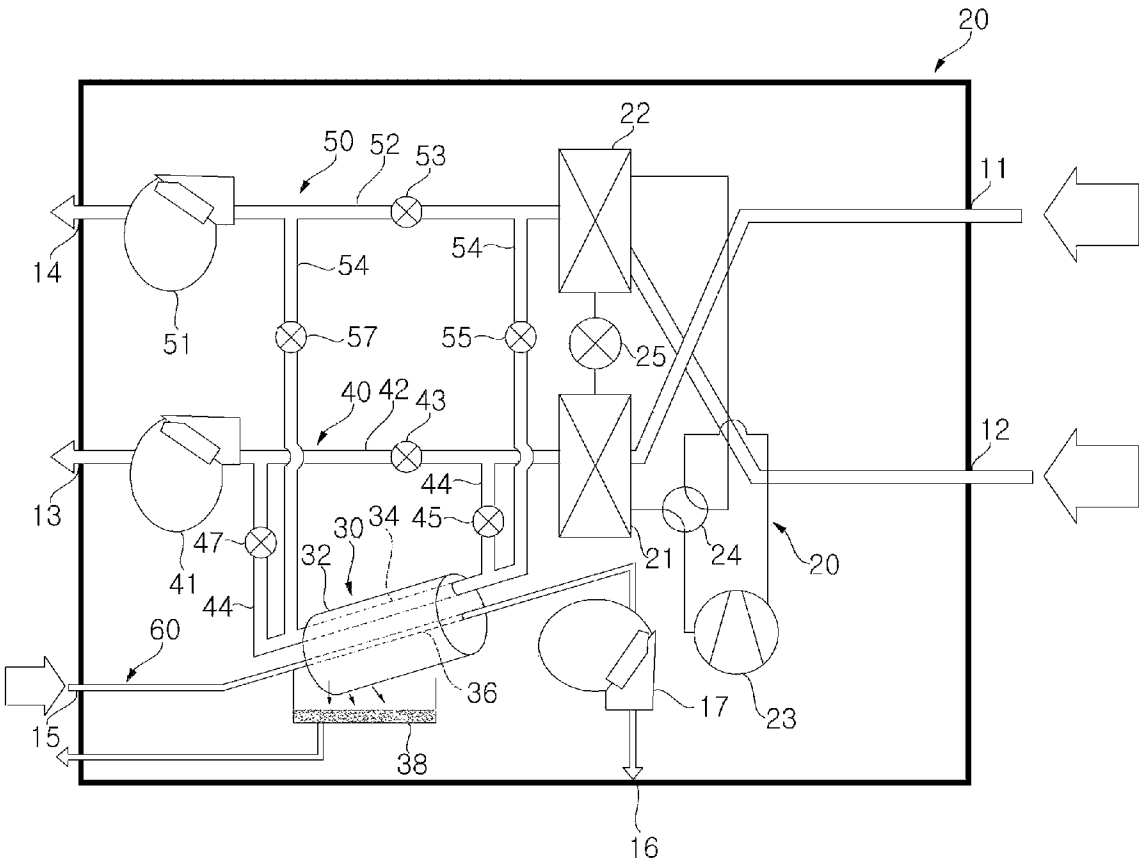
FIG. 1 is a view showing the structure of an air conditioner according to a first embodiment of the present invention.

The present invention will be described in detail with reference to the accompanying drawings.

In the following description of the present invention, a detailed description of known functions or configurations incorporated herein will be omitted when it may make the subject matter of the present invention rather unclear. The same terms may be denoted by different reference numerals if the terms indicate different parts.

The terms used in the following description are terms defined taking into consideration the functions obtained in accordance with the present invention. The definitions of these terms should be determined based on the whole content of this specification because they may be changed in accordance with the intentions of users, such as experimenters and measurers, or usual practices.

In this specification, the terms "first," "second," etc. are used to describe various elements. However, the elements are not limited by the terms. The terms are used only to distinguish one element from another element. For example, a first element may be named a second element, and a second element may be named a first element, without departing from the scope of right of the present invention. It will be understood that the term "and/or" refers to one or more possible combinations of specified relevant items and includes such combinations.

The terms used in this specification are provided only to explain specific embodiments, but are not intended to restrict the present invention. A singular representation may include a plural representation unless it represents a definitely different meaning from the context.

Unless otherwise defined, all terms, including technical and scientific terms, used in this specification have the same meaning as commonly understood by a person having ordinary skill in the art to which the present invention pertains. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In addition, the terms "comprises" and "includes" described herein should be interpreted not to exclude other elements but to further include such other elements since the corresponding elements may be inherent unless mentioned otherwise.

Figure 2:
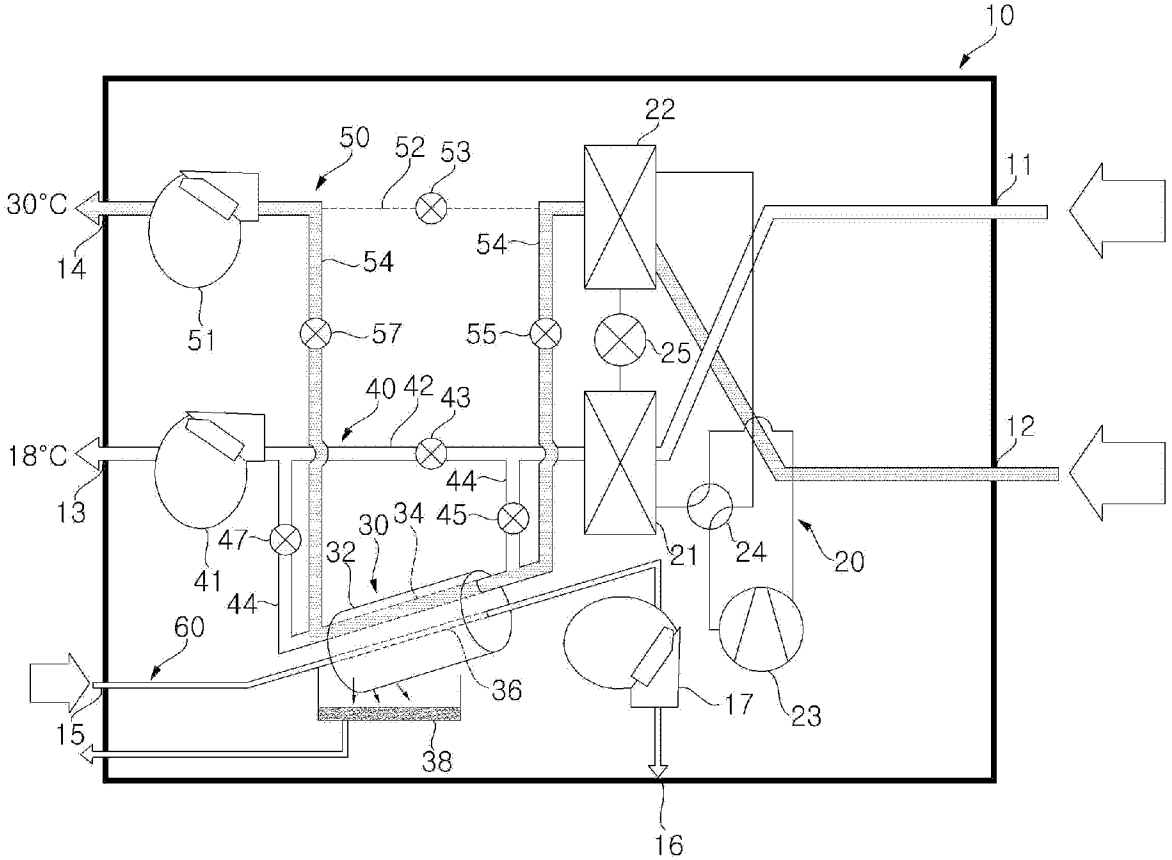
FIG. 2 is a view showing a first example of the operation of the air conditioner of FIG. 1.
Figure 3:
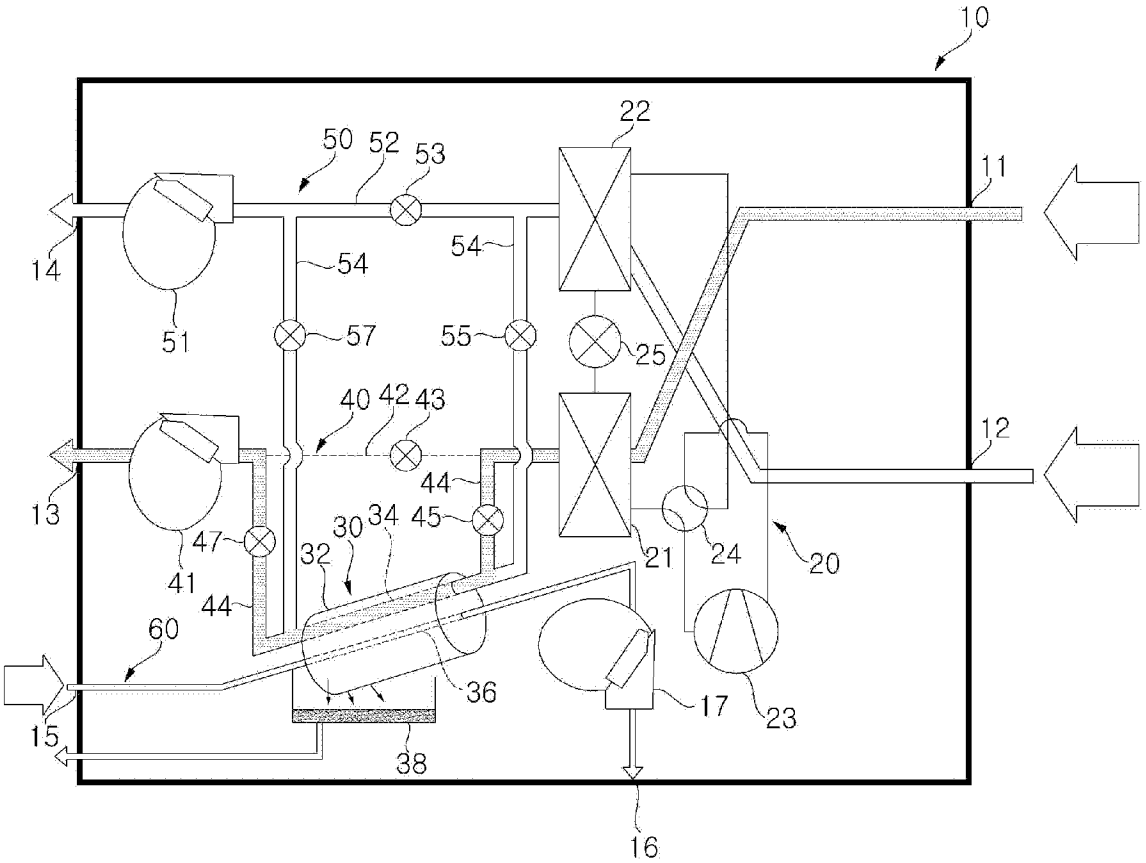
FIG. 3 is a view showing a second example of the operation of the air conditioner of FIG. 1.
Figure 4:
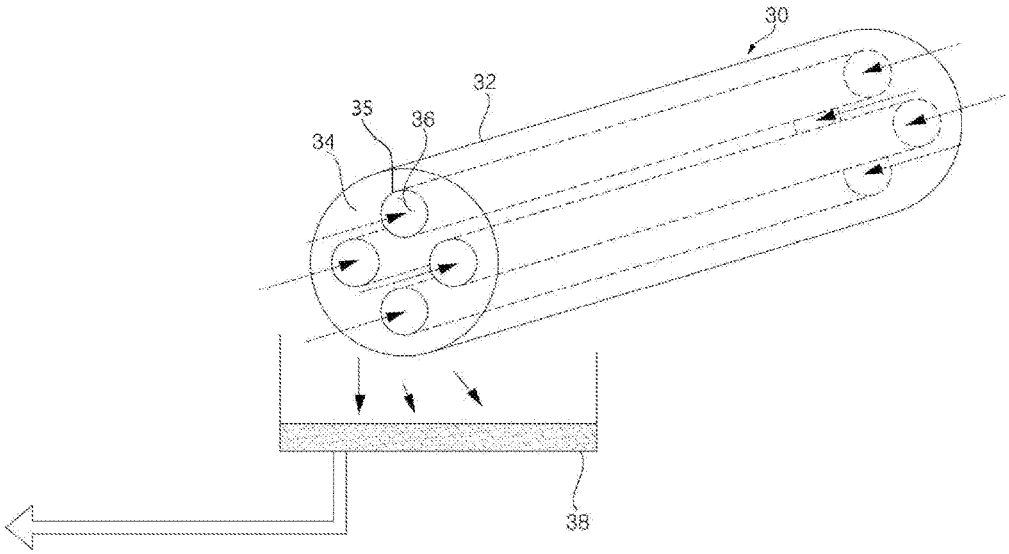
FIG. 4 is a perspective view of a condensing unit shown in FIG. 1.

FIG. 1 is a view showing the structure of an air conditioner according to a first embodiment of the present invention, FIG. 2 is a view showing a first example of the operation of the air conditioner of FIG. 1, FIG. 3 is a view showing a second example of the operation of the air conditioner of FIG. 1, and FIG. 4 is a perspective view of a condensing unit shown in FIG. 1.

Referring to these figures, the air conditioner according to this embodiment includes a case 10, an air conditioning unit 20 disposed in the case 10 for dehumidifying indoor air, and an condensing unit 30 for condensing regenerated air containing moisture as the result of regeneration performed by the air conditioning unit 20.

The air conditioner according to this embodiment is characterized in that air discharged indoors has low temperature. In addition, the air conditioner according to this embodiment is characterized in that air having passed through a condenser is discharged indoors in a state in which the temperature of the air is low.

In the air conditioner according to this embodiment, regenerated air having passed through the condenser is heat-exchanged with a cooling fluid, with the result that the temperature of the regenerated air has is low.

In the air conditioner according to this embodiment, regenerated air containing moisture as the result of having passed through the condenser is dehumidified by the condensing unit 30, and the dehumidified air is supplied indoors to minimize the increase in indoor humidity.

The case 10 includes a first indoor suction port 11, a second indoor suction port 12, a first indoor discharge port 13, a second indoor discharge port 14, a cooling fluid suction port 15, and a cooling fluid discharge port 16.

Indoor air suctioned through the first indoor suction port 11 may be discharged indoors through the first indoor discharge port 13 or the second indoor discharge port 14.

Indoor air suctioned through the second indoor suction port 12 may be discharged indoors through the first indoor discharge port 13 or the second indoor discharge port 14

In this embodiment, outdoor air having a low temperature is used as the cooling fluid. The cooling fluid passes through the condensing unit 30. Some other fluids having a lower temperature than indoor air may be used instead of the outdoor air. For example, water may be used as the cooling fluid.

Outdoor air is suctioned through the cooling fluid suction port 15, passes through the condensing unit 30, and is discharged through the cooling fluid discharge port 16.

The cooling fluid discharge port 16 may be connected indoors. The cooling fluid discharge port 16 may also be connected outdoors. In this embodiment, the cooling fluid discharge port 16 is connected outdoors.

A channel connected between the cooling fluid suction port 15 and the cooling fluid discharge port 16 is defined as a cooling channel 60. In the cooling channel 60 may be disposed a cooling fluid discharge fan 17 for enabling outdoor air to flow. In this embodiment, the cooling channel 60 is a channel along which outdoor air flows.

The outdoor air is heat-exchanged with air regenerated by the air conditioning unit 20.

Air heat-exchanged with a heat exchanger operating in a condenser in the air conditioning unit 20 is defined as regenerated air. In addition, air heat-exchanged with a heat exchanger operating in an evaporator in the air conditioning unit 20 is defined as dehumidified air. When indoor air passes through the evaporator, moisture in the air is condensed, with the result that the moisture is removed from the air.

The air conditioning unit 20 includes a compressor 23, a four-way valve 24, a first heat exchanger 21, a second heat exchanger 22, and an expansion valve 25.

The air conditioning unit 20 is operated according to a heat pump cycle in which the flow direction of a refrigerant is changed in order to perform heating or cooling. In the air conditioning unit 20, one selected from between the first heat exchanger 21 and the second heat exchanger 22 may operate as an evaporator, and the other may operate as a condenser.

In the air conditioning unit 20, the flow direction of the refrigerant is changed by the four-way valve 24, whereby the functions of the first heat exchanger 21 and the second heat exchanger 22 may be switched.

The first heat exchanger 21 is disposed in a channel along which the indoor air flows such that the first heat exchanger 21 exchanges heat with the indoor air flowing in the channel. The second heat exchanger 22 is disposed in a channel along which the indoor air flows such that the second heat exchanger 22 exchanges heat with the indoor air flowing in the channel. The indoor air flow channel in which the first heat exchanger 21 is disposed is different from the indoor air flow channel in which the second heat exchanger 22 is disposed.

A desiccant coating is performed on the surface of each of the first heat exchanger 21 and the second heat exchanger 22. The first heat exchanger 21 and the second heat exchanger 22 may absorb moisture from the air due to the desiccant coating.

The desiccant coating is a material that is capable of absorbing moisture from the air and discharging the absorbed moisture into the air when heat is applied to the desiccant coating. The desiccant coating is a material that is generally used by those skilled in the art, and therefore a detailed description thereof will be omitted.

In a case in which the first heat exchanger 21 operates as an evaporator, the second heat exchanger 22 operates as a condenser.

The first heat exchanger 21, operating as the evaporator, exchanges heat with indoor air, with the result that the desiccant coating formed on the surface of the first heat exchanger 21 absorbs moisture from the air. The second heat exchanger 22, operating as the condenser, exchanges heat with indoor air, with the result that moisture is evaporated from the desiccant coating formed on the surface of the second heat exchanger 22.

In a case in which the first heat exchanger 21 operates as a condenser as the result of switching the functions of the first heat exchanger 21 and the second heat exchanger 22, moisture is evaporated from the desiccant coating formed on the surface of the first heat exchanger 21, and the desiccant coating formed on the surface of the second heat exchanger 22 absorbs moisture.

In this embodiment, the indoor air flow channel is configured such that indoor air is suctioned indoors at two locations, and the indoor air is discharged at two locations.

In this embodiment, indoor air is suctioned through the first indoor suction port 11 and the second indoor suction port 12. The first indoor suction port 11 and the second indoor suction port 12 are disposed such that the first indoor suction port 11 and the second indoor suction port 12 are physically separated from each other. Unlike this embodiment, indoor air may be suctioned through a single indoor suction port, and may then flow in a state of having been divided into two parts.

The condensing unit 30 performs heat exchange between outdoor air and regenerated air in order to condense moisture contained in the regenerated air.

The regenerated air may be supplied from the first heat exchanger 21 operating as a condenser or the second heat exchanger 21 operating as a condenser.

The condensing unit 30 includes a condensing body 32, a regenerated air flow channel 34, formed in the condensing body 32, along which the regenerated air flows, a cooling fluid flow channel 36, formed in the condensing body 32, along which the outdoor air flows, and a drainage part 38 disposed at the lower side of the condensing body 32 for storing condensed water.

The condensing unit 30 performs heat exchange between outdoor air and regenerated air in order to condense moisture contained in the regenerated air, which has high temperature and high humidity, thereby dehumidifying the regenerated air.

When the regenerated air passes through the condenser, the regenerated air is heated to a higher temperature than the indoor air, with the result that the regenerated air absorbs moisture evaporated from the desiccant coating formed on the surface of the condenser. The outdoor air, which acts as a cooling fluid, has a lower temperature than the regenerated air.

In this embodiment, the condensing body 32 is formed to have a cylindrical shape. Unlike this embodiment, the condensing body 32 may be formed to have various other shapes.

The regenerated air flow channel 34 is disposed in the condensing body 32.

The cooling fluid flow channel 36 is disposed in the condensing body 32. In this embodiment, the regenerated air flow channel 34 is disposed so as to surround the cooling fluid flow channel 36. Unlike this embodiment, the cooling fluid flow channel 36 may be disposed so as to surround the regenerated air flow channel 34.

In this embodiment, the cooling fluid flow channel 36 is formed in a fluid duct 35. The fluid duct 35 is formed to have a pipe shape. Outdoor air, which acts as a cooling fluid, flows in the fluid duct 35. The fluid duct 35 is made of a metal material. Condensed water is formed outside the fluid duct 35.

A fluid, such as air or water, having a lower temperature than the regenerated air flow channel 34 flows in the cooling fluid flow channel 36.

Unlike this embodiment, the regenerated air flow channel 34 and the cooling fluid flow channel 36 may be configured so as to have structures opposite to the above structures. That is, the regenerated air flow channel 34 may be formed in the fluid duct 35, and the cooling fluid flow channel 36 may be formed outside the fluid duct 35.

In this embodiment, a plurality of cooling fluid flow channels 36 may be formed. In this case, the contact area between the cooling fluid flow channels 36 and the regenerated air is increased, with the result that it is possible to condense moisture more effectively.

In addition, heat radiation fins may be formed on the fluid duct 35. In this case, the contact area with the regenerated air may be increased in proportion to the area of the heat radiation fins.

The fluid duct 35 may be disposed in an inclined state such that condensed water formed on the fluid duct 35 can be collected into the drainage part 38. The condensing body 32 may also be disposed in a state in which the condensing body 32 is inclined toward the drainage part 38. The condensed water generated by the condensing unit 30 is stored in the drainage part 38.

The condensed water stored in the drainage part 38 may be discharged outward using a drainage pump (not shown). Unlike this embodiment, the condensed water may be discharged outward due to gravity.

Meanwhile, the case 10 includes flow channels along which indoor air and outdoor air flow.

Indoor air suctioned through the first indoor suction port 11 or the second indoor suction port 12 may flow to the first heat exchanger 21 and the second heat exchanger 22.

In this embodiment, the flow channels are configured such that indoor air introduced through the first indoor suction port 11 flows to the first heat exchanger 21 and such that indoor air introduced through the second indoor suction port 12 flows to the second heat exchanger 22, for the sake of convenience.

In the same manner, the flow channels are configured such that the indoor air having passed through the first heat exchanger 21 is discharged through the first indoor discharge port 13 and such that the indoor air having passed through the second heat exchanger 22 is discharged through the second indoor discharge port 14.

Unlike this embodiment, the flow channels may be configured such that indoor air flows through the first indoor suction port 11, the second heat exchanger 22, and the second indoor discharge port 14 in turn. In addition, the flow channels may be configured such that indoor air flows through the second indoor suction port 12, the first heat exchanger 21, and the second indoor discharge port 14 in turn.

That is, the positions of the indoor suction ports, through which indoor air is suctioned, and the positions of the indoor discharge ports, through which indoor air is discharged, may be variously changed by those skilled in the art.

In this embodiment, the flow channel formed by the first indoor suction port 11, the first heat exchanger 21, and the first indoor discharge port 13 is defined as a first indoor flow channel 40.

In addition, the flow channel formed by the second indoor suction port 12, the second heat exchanger 22, and the second indoor discharge port 14 is defined as a second indoor flow channel 50.

However, the idea of the present invention is not limited to this configuration of the flow channels, which has been described merely to distinguish between the first indoor flow channel and the second indoor flow channel.

In this embodiment, a first indoor discharge fan 41 is disposed in the first indoor flow channel 40, and a second indoor discharge fan 51 is disposed in the second indoor flow channel 50.

The first indoor flow channel 40 includes a first main indoor flow channel 42, along which indoor air directly flows from the first heat exchanger 21 to the first indoor discharge port 13, and a first regeneration indoor flow channel 44, along which indoor air flows from the first heat exchanger 21 to the first indoor discharge port 13 via the condensing unit 30.

The first regeneration indoor flow channel 44 may guide the air having passed through the first heat exchanger 21 to the condensing unit 30, and may guide the air having passed through the condensing unit 30 to the first indoor discharge port 13.

The first regeneration indoor flow channel 44 may be configured separately from the first main indoor flow channel 42. In this embodiment, the first regeneration indoor flow channel 44 may diverge from the first main indoor flow channel 42.

The first regeneration indoor flow channel 44 diverges from the first main indoor flow channel 42, and is connected to the regenerated air flow channel 34 of the condensing unit 30.

Consequently, air flowing to the regenerated air flow channel 34 through the first regeneration indoor flow channel 44 is heat-exchanged with outdoor air, and is then returned to the first main indoor flow channel 42. The returned air passes through the first indoor discharge fan 41, and is then discharged through the first indoor discharge port 13.

Dampers for controlling the flow direction of indoor air may be installed in the first main indoor flow channel 42 and the first regeneration indoor flow channel 44. The dampers may be manipulated such that suctioned indoor air can flow to the first main indoor flow channel 42 or the first regeneration indoor flow channel 44.

In this embodiment, a first main damper 43 is disposed in the first main indoor flow channel 42. In this embodiment, dampers 45 and 47 may be disposed in an inlet side and an outlet side of the first regeneration indoor flow channel 44, respectively.

The damper installed in the inlet side of the first regeneration indoor flow channel 44 is defined as a first inlet damper 45, and the damper installed in the outlet side of the first regeneration indoor flow channel 44 is defined as a first outlet damper 47.

The flow channels may be variously configured by opening and closing the first main damper 43, the first inlet damper 45, or the first outlet damper 47.

When the first main damper 43 is opened, air heat-exchanged with the first heat exchanger 21 may flow along the first main indoor flow channel 42.

When the first main damper 43 is closed, air heat-exchanged with the first heat exchanger 21 may not flow along the first main indoor flow channel 42, but may flow to the first regeneration indoor flow channel 44.

When the first inlet damper 45 is opened, some of the air flowing along the first main indoor flow channel 42 may flow to the first regeneration indoor flow channel 44. When the first inlet damper 45 is closed, the air in the first main indoor flow channel 42 may not flow to the first regeneration indoor flow channel 44.

When the first outlet damper 47 is opened, the air flowing along the first regeneration indoor flow channel 44 may flow to the first main indoor flow channel 42. The air in the first main indoor flow channel 42 may be introduced into the first regeneration indoor flow channel 44 due to the pressure difference between the first main indoor flow channel 42 and the first regeneration indoor flow channel 44.

When the first outlet damper 47 is closed, it is possible to prevent the introduction of indoor air from the first main indoor flow channel 42 to the outlet side of the first regeneration indoor flow channel 44.

The second indoor flow channel 50 has the same structure as the first indoor flow channel 40.

The second indoor flow channel 50 includes a second main indoor flow channel 52, along which indoor air directly flows from the second heat exchanger 22 to the second indoor discharge port 14, and a second regeneration indoor flow channel 54, along which indoor air flows from the second heat exchanger 22 to the second indoor discharge port 14 via the condensing unit 30.

The second regeneration indoor flow channel 54 may guide the air having passed through the second heat exchanger 22 to the condensing unit 30, and may guide the air having passed through the condensing unit 30 to the second indoor discharge port 14.

The second regeneration indoor flow channel 54 may be configured separately from the second main indoor flow channel 52. In this embodiment, the second regeneration indoor flow channel 54 may diverge from the second main indoor flow channel 52.

A second main damper 53 is disposed in the second main indoor flow channel 52. A second inlet damper 55 is disposed in an inlet side of the second regeneration indoor flow channel 54, and a second outlet damper 57 is disposed in an outlet side of the second regeneration indoor flow channel 54.

The flow channels may be variously configured by opening and closing the second main damper 53, the second inlet damper 55, or the second outlet damper 57.

Hereinafter, the operation of the air conditioner according to the first embodiment of the present invention will be described in more detail with reference to FIG. 2 or 3.

Referring first to FIG. 2, the first heat exchanger 21 of the air conditioning unit 20 operates as an evaporator, and the second heat exchanger 22 of the air conditioning unit 20 operates as a condenser.

A refrigerant compressed by the compressor 23 of the air conditioning unit 20 flows to the second heat exchanger 22 through the four-way valve 24.

The second heat exchanger 22 exchanges heat with indoor air suctioned through the second indoor suction port 12, and the refrigerant is condensed as the result of the heat exchange. During the condensation of the refrigerant, the second heat exchanger 22 discharges heat to the surroundings thereof, with the result that the surroundings of the second heat exchanger 22 are heated.

The refrigerant, condensed by the second heat exchanger 22, passes through the expansion valve 25, and then flows to the first heat exchanger 21.

The first heat exchanger 21 exchanges heat with indoor air suctioned through the first indoor suction port 11, and the refrigerant is evaporated as the result of the heat exchange. During the evaporation of the refrigerant, the first heat exchanger 21 absorbs heat from the surroundings thereof, with the result that the surroundings of the first heat exchanger 21 are cooled.

The evaporated refrigerant flows to the compressor through the four-way valve 24, and then the above-described procedure is repeated.

When heat is discharged from the second heat exchanger 22, moisture clinging to the surface of the second heat exchanger 22 may evaporate.

When the moisture absorbed by the desiccant coating formed on the surface of the second heat exchanger 22 is evaporated, the desiccant coating may be regenerated such that the desiccant coating can again absorb moisture.

The flow channel is controlled such that regenerated air, having passed through the condenser (the second heat exchanger), flows to the second main indoor flow channel 52, and then passes through the condensing unit 30.

Under the control of a controller, the second main damper 53, disposed in the second main indoor flow channel 52, is closed, and the second inlet damper 55 and the second outlet damper 57, disposed in the second regeneration indoor flow channel 54, are opened.

Consequently, the regenerated air, introduced into the second indoor flow channel 50, flows to the second regeneration indoor flow channel 54, and then passes through the regenerated air flow channel 34 of the condensing unit 30.

The regenerated air, passing through the regenerated air flow channel 34, is heat-exchanged with outdoor air. At this time, the moisture contained in the regenerated air is condensed. The condensed water, generated as the result of condensing moisture in the regenerated air, is stored in the drainage part 38.

While the regenerated air passes through the condensing unit 30, the temperature of the regenerated air is lowered. The regenerated air having a lowered temperature passes through the second indoor discharge fan 51, and is then discharged through the second indoor discharge port 14. The regenerated air, heat-exchanged with outdoor air, may have a slightly higher temperature than the outdoor air.

Meanwhile, indoor air suctioned through the first indoor suction port 11 is heat-exchanged with the first heat exchanger 21 operating as the evaporator. As the result of the heat exchange, moisture contained in the indoor air may be absorbed by the desiccant coating formed on the surface of the first heat exchanger 21.

The air having passed through the evaporator (the first heat exchanger), disposed in the first indoor flow channel 40, i.e. dehumidified air, is directly discharged indoors.

Under the control of the controller, the first main damper 43, disposed in the first main indoor flow channel 42, is opened, and the first inlet damper 45 and the first outlet damper 47, disposed in the first regeneration indoor flow channel 44, are closed.

Consequently, the air, cooled and dehumidified as the result of having passed through the first heat exchanger 21, passes through the first indoor discharge fan 41, and is then directly discharged indoors.

With the passage of time, the dehumidification efficiency of the first heat exchanger 21 operating as the evaporator is lowered below a reference value. When more than a predetermined amount of moisture is absorbed by the desiccant coating formed on the surface of the first heat exchanger 21, the amount of moisture to be absorbed by the desiccant coating is reduced. In this case, the heat pump cycle is changed, thereby switching the functions of the first heat exchanger 21 and the second heat exchanger 22.

Referring to FIG. 3, the first heat exchanger 21 operates as a condenser, and the second heat exchanger 22 operates as an evaporator, in the opposite manner to FIG. 2.

Under the control of the controller, therefore, the first main damper 43, disposed in the first main indoor flow channel 42 of the first indoor flow channel 40, is closed, and the first inlet damper 45 and the first outlet damper 47, disposed in the first regeneration indoor flow channel 44, are opened.

As a result, regenerated air, having passed through the condenser (the first heat exchanger) flows to the regenerated air flow channel 34 of the condensing unit 30 through the first regeneration indoor flow channel 44.

As previously described, the condensing unit 30 performs heat exchange between the regenerated air and outdoor air in order to condense moisture contained in the regenerated air, with the result that the temperature and humidity of the regenerated air are lowered.

The regenerated air, having passed through the condensing unit 30, passes through the first indoor discharge fan 41, and is then discharged through the first indoor discharge port 13.

The dehumidified air, having passed through the evaporator (the second heat exchanger), passes through the second main indoor flow channel 52 of the second indoor flow channel 50 and the second indoor discharge fan 51, and is then directly discharged indoors.

In the air conditioner according to this embodiment, the dehumidified air, having passed through the evaporator, is directly discharged indoors, and the regenerated air, having passed through the condenser, is discharged indoors in a state in which the temperature of the regenerated air is lowered as the result of heat exchange between the regenerated air and outdoor air. In the air conditioner according to this embodiment, therefore, the regenerated air and the dehumidified air are discharged indoors in a state in which the temperatures of the regenerated air and the dehumidified air are lowered, thereby providing a more comfortable indoor environment.

In the air conditioner according to this embodiment, indoor air is condensed and dehumidified as the result of having passed through the evaporator, and regenerated air having passed through the condenser is also condensed as the result of heat exchange with outdoor air. Consequently, the air conditioner has the effect of condensing the indoor air twice.

In the air conditioner according to this embodiment, a ratio in high and low pressure of the first heat exchanger 21 to the second heat exchanger 22 is lower than that in a general heat pump cycle. Consequently, it is possible to reduce an amount of condensed radiation from a heat exchanger operating as the condenser. When the amount of condensed radiation from the condenser is reduced, the indoor discharge temperature of regenerated air having passed through the condenser may be lowered than that in a general heat pump cycle.

Figure 5:
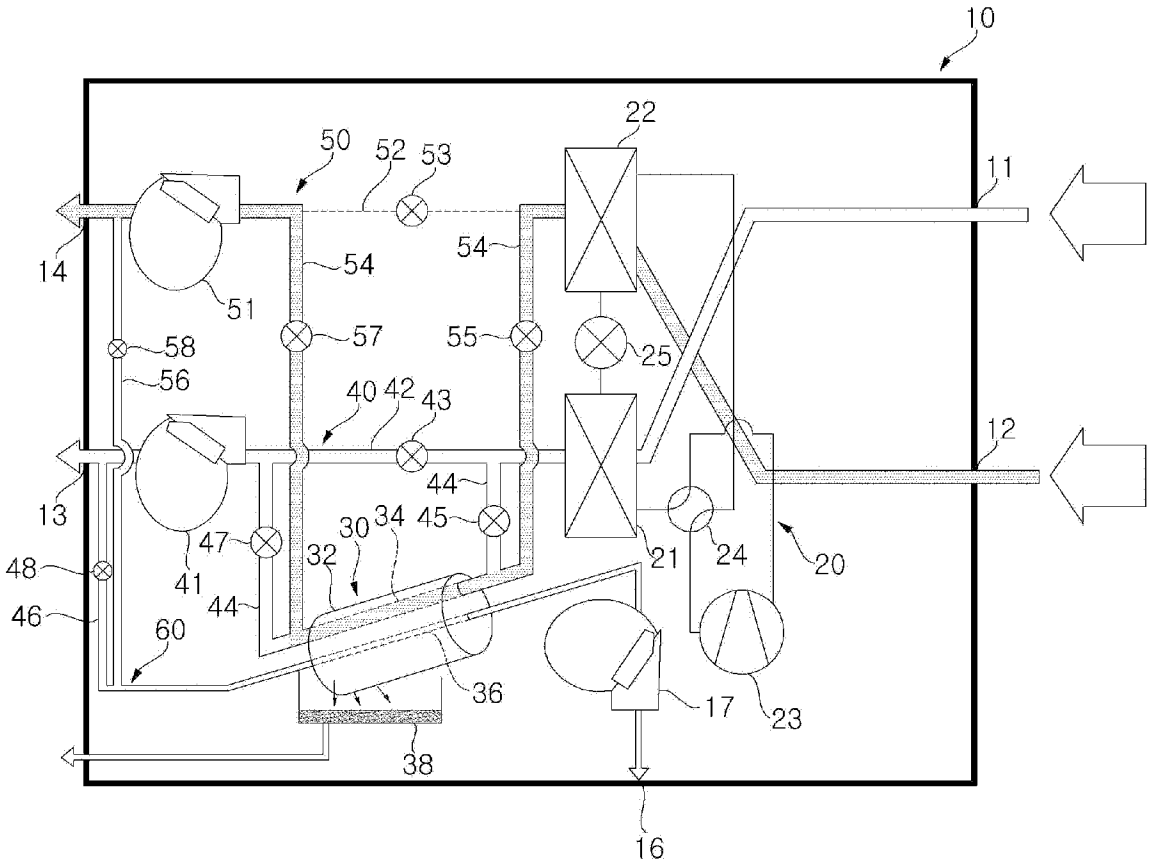
FIG. 5 is a view showing a first example of the operation of an air conditioner according to a second embodiment of the present invention.
Figure 6:
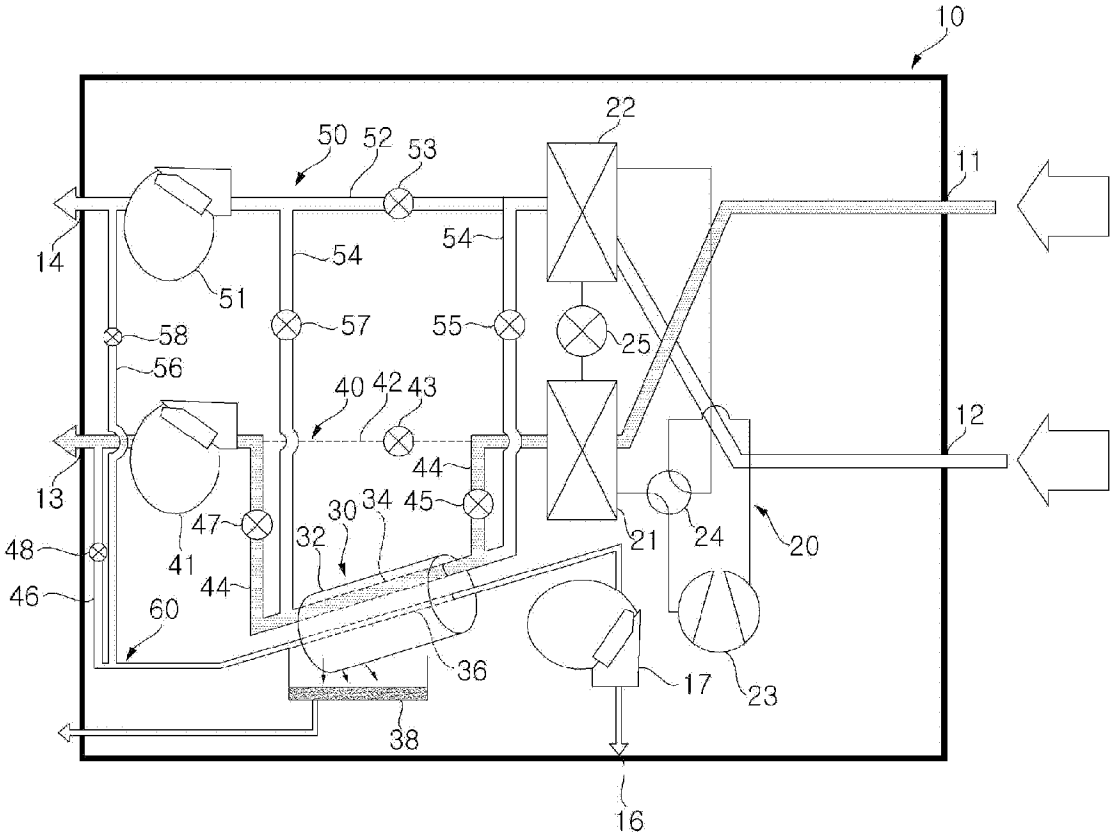
FIG. 6 is a view showing a second example of the operation of the air conditioner according to the second embodiment of the present invention.

FIG. 5 is a view showing a first example of the operation of an air conditioner according to a second embodiment of the present invention, and FIG. 6 is a view showing a second example of the operation of the air conditioner according to the second embodiment of the present invention.

The air conditioner according to this embodiment is characterized in that some of the dehumidified air having passed through the evaporator is bypassed and supplied to the condensing unit in place of outdoor air.

In this embodiment, the dehumidified air is used as a cooling fluid for condensing the regenerated air.

Consequently, the air conditioner according to this embodiment further includes a first bypass channel 46 disposed in the first indoor flow channel 40 for connecting the first main indoor flow channel 42 to the cooling fluid flow channel 36 of the condensing unit 30 and a first bypass damper 48 for opening and closing the first bypass channel 46.

In addition, the air conditioner according to this embodiment further includes a second bypass channel 56 disposed in the second indoor flow channel 50 for connecting the second main indoor flow channel 52 to the cooling fluid flow channel 36 of the condensing unit 30 and a second bypass damper 58 for opening and closing the second bypass channel 56.

In this embodiment, two suction ports and three discharge ports are provided. In this embodiment, no cooling fluid suction port 15 is provided, unlike the first embodiment.

The cooling fluid discharge port 16, connected to the cooling fluid flow channel 36, may be connected indoors or outdoors. In this embodiment, the cooling fluid discharge port 16 is connected indoors.

In this embodiment, therefore, all of the two suction ports and the three discharge ports are connected indoors.

Hereinafter, the operation of the air conditioner according to this embodiment will be described with reference to FIGS. 5 and 6.

Referring to FIG. 5, the first heat exchanger 21 operates as an evaporator, and the second heat exchanger 22 operates as a condenser.

Consequently, dehumidified air, having passed through the first indoor flow channel 40, is directly discharged indoors through the first indoor discharge port 13.

Some of the dehumidified air flowing in the first indoor flow channel 40 is bypassed and flows to the condensing unit 30. To this end, the first bypass damper 48 is opened under control of the controller, with the result that some of the dehumidified air flows to the cooling fluid flow channel 36 through the first bypass channel 46.

The dehumidified air, having flowed to the cooling fluid flow channel 36, is heat-exchanged with regenerated air, having passed through the condenser. As a result, the regenerated air is condensed.

The dehumidified air, having passed through the condensing unit 30, is discharged through the cooling fluid discharge port 16.

The dehumidified air discharged through the cooling fluid discharge port 16 has a lower temperature than the regenerated air. In this embodiment, the dehumidified air is used as a cooling fluid instead of outdoor air. As a result, the temperature of the air discharged through the cooling fluid discharge port 16 is low.

The temperature of the air discharged through the cooling fluid discharge port 16 is lower than that in the first embodiment.

Referring to FIG. 6, the first heat exchanger 21 operates as a condenser, and the second heat exchanger 22 operates as an evaporator. Under the control of the controller, the second bypass channel 56 of the second indoor flow channel 50 is opened such that some of the dehumidified air flows to the cooling fluid flow channel 36.

In the air conditioner according to this embodiment, the number of discharge ports is one less than in the first embodiment, whereby it is possible to further simplify the structure of the duct, through which air is discharged.

In the air conditioner according to this embodiment, the dehumidified air having passed through the condensing unit 30 may be discharged indoors, or may be exhausted outdoors, making it possible to more freely select an installation environment.

In the air conditioner according to this embodiment, all of the suction ports and discharge ports may be connected indoors, whereby it is possible to minimize the structure and length of the duct.

The other constructions of this embodiments are identical to those of the first embodiment, and therefore a detailed description thereof will be omitted.

As is apparent from the above description, the present invention has one or more of the following effects.

First, dehumidified air, having passed through the evaporator, is directly discharged indoors, and regenerated air, having passed through the condenser, is discharged indoors in a state in which the temperature of the regenerated air is lowered as the result of heat exchange between the regenerated air and outdoor air. Consequently, it is possible to discharge air indoors in a state in which the temperature of the air is lowered, thereby providing a more comfortable indoor environment.

Second, indoor air is condensed and dehumidified as the result of having passed through the evaporator, and regenerated air having passed through the condenser is also condensed as the result of heat exchange with outdoor air. Consequently, it is possible to condense both the air having passed through the evaporator and the air having passed through the condenser.

Third, a ratio in high and low pressure of the first heat exchanger to the second heat exchanger is lowered. Consequently, it is possible to reduce an amount of condensed radiation, thereby lowering the temperature of regenerated air.

It should be noted that effects of the present invention are not limited to the effects of the present invention as mentioned above, and other unmentioned effects of the present invention will be clearly understood by those skilled in the art from the following claims.

It will be apparent that, although the embodiments of the present invention have been described above with reference to the accompanying drawings, the present invention is not limited to the above-described specific embodiments, and therefore various modifications and variations can be made by those skilled in the art without departing from the gist of the appended claims. Thus, it is intended that the modifications and variations should not be understood independently of the technical spirit or prospect of the present invention. The above embodiments are therefore to be construed in all aspects as illustrative and not restrictive.

What is claimed is:

1. An air conditioner comprising:

a case provided with a first and a second indoor suction port, and a first and a second indoor discharge port;

an air conditioning unit to operate according to a heat pump cycle, the air conditioning unit provided with a first heat exchanger to operate as one of an evaporator and a condenser, and a second heat exchanger to operate as the other of the evaporator and the condenser;

a first indoor flow channel connected between the first indoor suction port and the first indoor discharge port, the first indoor flow channel to allow an indoor air suctioned through the first indoor suction port to pass through the first heat exchanger and discharge through the first indoor discharge port;

a second indoor flow channel connected between the second indoor suction port and the second indoor discharge port, the second indoor flow channel to allow the indoor air suctioned through the second indoor suction port to pass through the second heat exchanger and discharge through the second indoor discharge port; and a condensing unit to receive regenerated air, heat-exchanged with the condenser, from one of the first indoor flow channel and the second indoor flow channel, and perform a heat exchange between the regenerated air and a cooling fluid having a lower temperature than the regenerated air so as to condense moisture contained in the regenerated air, wherein the first indoor flow channel comprises:

a first main indoor flow channel connected between the first heat exchanger and the first indoor discharge port;

a first regeneration indoor flow channel diverged from the first main indoor flow channel, passed through the condensing unit and connected the first indoor discharge port;

wherein the second indoor flow channel comprises:

a second main indoor flow channel connected between the second heat exchanger and the second indoor discharge port;

a second regeneration indoor flow channel diverged from the second main indoor flow channel, passed through the condensing unit and connected the second indoor discharge port;

wherein the condensing unit comprises:

a regenerated air flow channel connected to the first regeneration indoor flow channel and the second main indoor flow channel to receive the regenerated air, heat-exchanged with the condenser, from one of the first regeneration indoor flow channel and the second main indoor flow channel.

2. The air conditioner of claim 1, wherein the cooling fluid is an outdoor air.

3. The air conditioner of claim 2, wherein the case further comprises:

a cooling fluid suction port to suction the outdoor air, and a cooling fluid discharge port to discharge the outdoor air.

4. The air conditioner of claim 3, wherein the cooling fluid discharge port is connected to one of an indoors and an outdoors.

5. The air conditioner of claim 1, wherein inlet and outlet portions of the first regeneration indoor flow channel are connected to the first main indoor flow channel.

6. The air conditioner of claim 1, wherein inlet and outlet portions of the second regeneration indoor flow channel are connected to the second main indoor flow channel.

7. The air conditioner of claim 1, wherein the condensing unit is connected to one of the first regeneration indoor flow channel and the second regeneration indoor flow channel to receive the regenerated air and perform heat exchange between the regenerated air and the cooling fluid to condense moisture contained in the regenerated air.

8. The air conditioner of claim 7, wherein the cooling fluid is an outdoor air, and the case further comprises:

a cooling fluid suction port to suction the outdoor air, and a cooling fluid discharge port to discharge the outdoor air.

9. The air conditioner of claim 7, wherein the cooling fluid is dehumidified air, the dehumidified air formed as a result of having passed through the evaporator from one of the first indoor flow channel and the second indoor flow channel.

10. The air conditioner of claim 1, wherein the condensing unit comprises:

a condensing body;

the regenerated air flow channel, provided in the condensing body, through which the regenerated air flows;

a cooling fluid flow channel, provided in the condensing body, through which the cooling fluid flows; and a drainage part provided at a lower side of the condensing body to store condensed water.

11. The air conditioner of claim 10, wherein the regenerated air flow channel surrounds the cooling fluid flow channel.

12. The air conditioner of claim 10, wherein the condensing unit is provided in an inclined position relative to the drainage part.

13. The air conditioner of claim 7, further comprising:

a first main damper provided in the first main indoor flow channel to open and close the first main indoor flow channel;

a first inlet damper provided in an inlet side of the first regeneration indoor flow channel to open and close the first regeneration indoor flow channel; and a first outlet damper provided in an outlet side of the first regeneration indoor flow channel to open and close the first regeneration indoor flow channel.

14. The air conditioner of claim 7, further comprising:

a second main damper provided in the second main indoor flow channel to open and close the second main indoor flow channel;

a second inlet damper provided in an inlet side of the second regeneration indoor flow channel to open and close the second regeneration indoor flow channel; and a second outlet damper provided in an outlet side of the second regeneration indoor flow channel to open and close the second regeneration indoor flow channel.

* * * * *